US005957075A

United States Patent [19]

Byrne, Sr. et al.

[11] Patent Number: 5,957,075

[45] Date of Patent: Sep. 28, 1999

[54] REMOTELY CONTROLLED MOORING LINE QUICK RELEASE APPARATUS

[75] Inventors: Gerard D. Byrne, Sr.; David Tompkins, both of Morgan City, La.

[73] Assignee: Safety Quik, L.L.C., Morgan City, La.

[21] Appl. No.: 08/940,314

[22] Filed: Sep. 30, 1997

[51] Int. Cl.[6] ..... B63B 21/00

[52] U.S. Cl. ..... 114/230; 114/249; 114/251; 294/82.33

[58] Field of Search ..... 114/230, 249, 114/251, 252, 253, 199, 200; 294/82.33, 82.34

[56] References Cited

U.S. PATENT DOCUMENTS

| | | | |
|---|---|---|---|
| 4,531,470 | 7/1985 | Paul | 114/230 |
| 4,587,920 | 5/1986 | Thompson | 114/251 |
| 4,677,930 | 7/1987 | Ortloff | 114/230 |
| 5,123,374 | 6/1992 | McMillan | 114/230 |

FOREIGN PATENT DOCUMENTS

| | | | |
|---|---|---|---|
| 978682 | 12/1964 | United Kingdom | 114/249 |

*Primary Examiner*—Jesus D. Sotelo
*Attorney, Agent, or Firm*—George A. Bode; Lisa D. Charouel; Bode & Associates

[57] ABSTRACT

The mooring line quick release device for quickly releasing a mooring line comprising a chamber, a mooring line support shaft and a mechanical system. The chamber, which is compact and sealed, has a first compartment and a second compartment separated by an open channel bounded by a wall of the first compartment, having formed therein a first aperture, and a wall of the second compartment, having formed therein a second aperture. The mooring line support shaft supports a mooring line wherein the mooring line support shaft has a longitudinal surface which passes through the first aperture to the second apertures via the open channel when the mooring line support shaft is changed between a first state to a second state thereof. The remotely control mechanical system serves to change the mooring-line support shaft from the second state to the first state via a third state for quickly releasing mooring line. When the mooring line support shaft is in the third state, mooring line support shaft is being retracted out of the second compartment and into the first compartment via the open channel for the quick release of the mooring line.

15 Claims, 7 Drawing Sheets

REMOTELY CONTROLLED MOORING LINE QUICK RELEASE APPARATUS

BACKGROUND OF THE INVENTION

1. Field of the Invention

The present invention relates to remote controlled mooring line release devices and, more particularly, to a remotely controlled mooring line quick release device having a compact and sealed chamber for housing therein a remotely controlled mechanical means whereby such remotely controlled mechanical means is protected from the environment, adverse weather conditions and corrosive properties of the waterway. Furthermore, such remotely controlled mechanical means serves to quickly release a mooring line remotely actuated, especially, under conditions of high tension, such as, without limitation, during high seas, without hazard or danger to personnel.

2. General Background

Typically in marine offshore operations, a marine vessel, such as, without limitation, barges, floating barracks, supply ships, or other boat-like vessels, is moored from a mooring vessel, such as, without limitation, offshore platforms, rigs, or other marine structures via a mooring device. However, during high seas the forces caused by high winds, waves or other turbulence acting upon the moored marine vessel makes it extremely difficult if not impossible to immediately release the hawser or mooring line. The immediate release of the hawser is hindered since the marine vessel is often violently thrashed wherein when releasing such hawser the personnel may be harmed or injury in the process due to such thrashing. Additionally, in other emergency situations for example due to a fire or explosion, it is highly desirable to immediately release the hawser of the marine vessel without harm or injury to personnel. The reliability and durability of the mooring device is critical in all weather conditions and diverse environments, such as, without limitation, snow and rain for the immediate release of the mooring line or hawser. Mooring arms which extend beyond the perimeter of the marine vessel, during high seas, wind and waves, are susceptible to becoming damaged or causing damage to a mooring vessel. Moreover, if the mooring device is damaged, the marine vessel cannot be easily retrieved, after being released.

Several devices have been patented which are aimed at remotely releasing the hawser or mooring line of a marine vessel from a mooring device.

U.S. Pat. No. 3,971,328, by Edling et al., is directed to an emergency mooring release device comprising a hydraulic cable cutter for cutting cable mooring lines.

U.S. Pat. No. 5,209,175, by Cintron, is also directed to an emergency release device which cuts cable mooring lines.

U.S. Pat. No. 4,072,122, by Balston, is directed to a hydro-pneumatic mooring device that secures and releases a mooring or towing hawser to a vessel. The hawser is received about a movable bollard drum and is clamped or secured in position. As the movable bollard drum is moved the hawser may be automatically freed.

U.S. Pat. No. 4,677,930, by Ortloff, is directed to a hydraulically operated apparatus for the quick release of an offshore floating storage vessel from a riser. The apparatus is a connector adapted to quickly disengage a mooring section of the vessel and riser. The connector comprises a pin member engageable with a hook of a latch member which is rotated once the hook engages the pin member and a plunger then advances into an open region of the hook prohibiting the rotational movement of the latch member, thereby locking the two mooring systems together.

U.S. Pat. No. 4,041,887, by Paul, is directed to a mooring device located on a dock post or a mooring post. The mooring device receives a mooring line for mooring a boat and releases the mooring line after receiving a radio signal.

U.S. Pat. No. 5,123,374, by McMillan, is directed to a releasable toggle locking mooring hook that can release a mooring line manually, mechanically or automatically by a pre-set tension.

Other patents present in the art are U.S. Pat. No. 4,741,716, by Hasebe, et al.; U.S. Pat. No. 5,372,531, by Boatman et al.; and U.S. Pat. No. 4,480,575, by Delamare; all of which are directed to mooring devices that can be remotely controlled, but do not meet the needs of the apparatus of the present invention.

SUMMARY OF THE PRESENT INVENTION

The preferred embodiment of the remotely controlled mooring line quick release device of the present invention solves the aforementioned problems in a straight forward and simple manner. What is provided is a remotely controlled mooring line quick release device having a compact and sealed chamber for housing therein a remotely controlled mechanical means whereby such remotely controlled mechanical means is protected from the environment, adverse weather conditions and corrosive properties of the waterway. Furthermore, such remotely controlled mechanical means serves to quickly release a mooring line remotely actuated, especially, under conditions of high tension, such as, without limitation, during high seas, without hazard or danger to personnel.

The mooring line quick release device for quickly releasing a mooring line comprises a means for housing, a mooring line support means and a mechanical means. The means for housing, which is compact and sealed, has a first compartment and a second compartment separated by an open channel bounded by a wall of said first compartment, having formed therein a first aperture, and a wall of said second compartment, having formed therein a second aperture. The mooring line support means supports a mooring line wherein said mooring line support means has a longitudinal surface which passes through said first aperture to said second apertures via said open channel when said mooring line support means is changed between a first state to a second state thereof. The remotely control mechanical means serves to change said mooring line support means from said second state to said first state via a third state for quickly releasing said mooring line. When said mooring line support means is in said third state, said mooring line support means is being retracted out of said second compartment and into said first compartment via said open channel for the quick release of said mooring line.

In view of the above, it is an object of the present invention to provide a remotely controlled mooring line quick release device having a sealed chamber for housing therein a remotely controlled mechanical means whereby such remotely controlled mechanical means is protected from the environment, adverse weather conditions and corrosive properties of the waterway for extending the useful life thereof.

Another object of the present invention is to provide a remotely controlled mooring line quick release device having a remotely controlled mechanical means which allows the sealed chamber to be compact such that the device may be positioned on the gunnels of the marine vessel.

A further object of the present invention is to provide a remotely controlled mooring line quick release device which can be remotely controlled to release the hawser or mooring line in emergency situations or other high tension situations.

A still further object of the present invention is to provide a remotely controlled mooring line quick release device which may be operated from a mooring vessel distant from the moored marine vessel or from controls of the marine vessel.

It is a still further object of the present invention to provide a hydraulically operated mechanical means which is durable and reliable.

It is a still further object of the present invention to provide remotely controlled mooring line quick release device which requires little or no maintenance and is otherwise easily serviced.

In view of the above objects it is a feature of the present invention to provide a remotely controlled mooring line quick release device having a sealed chamber which is simple to manufacture.

It is another feature of the present invention to provide a remotely controlled mooring line quick release device which is simple to use.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1A:
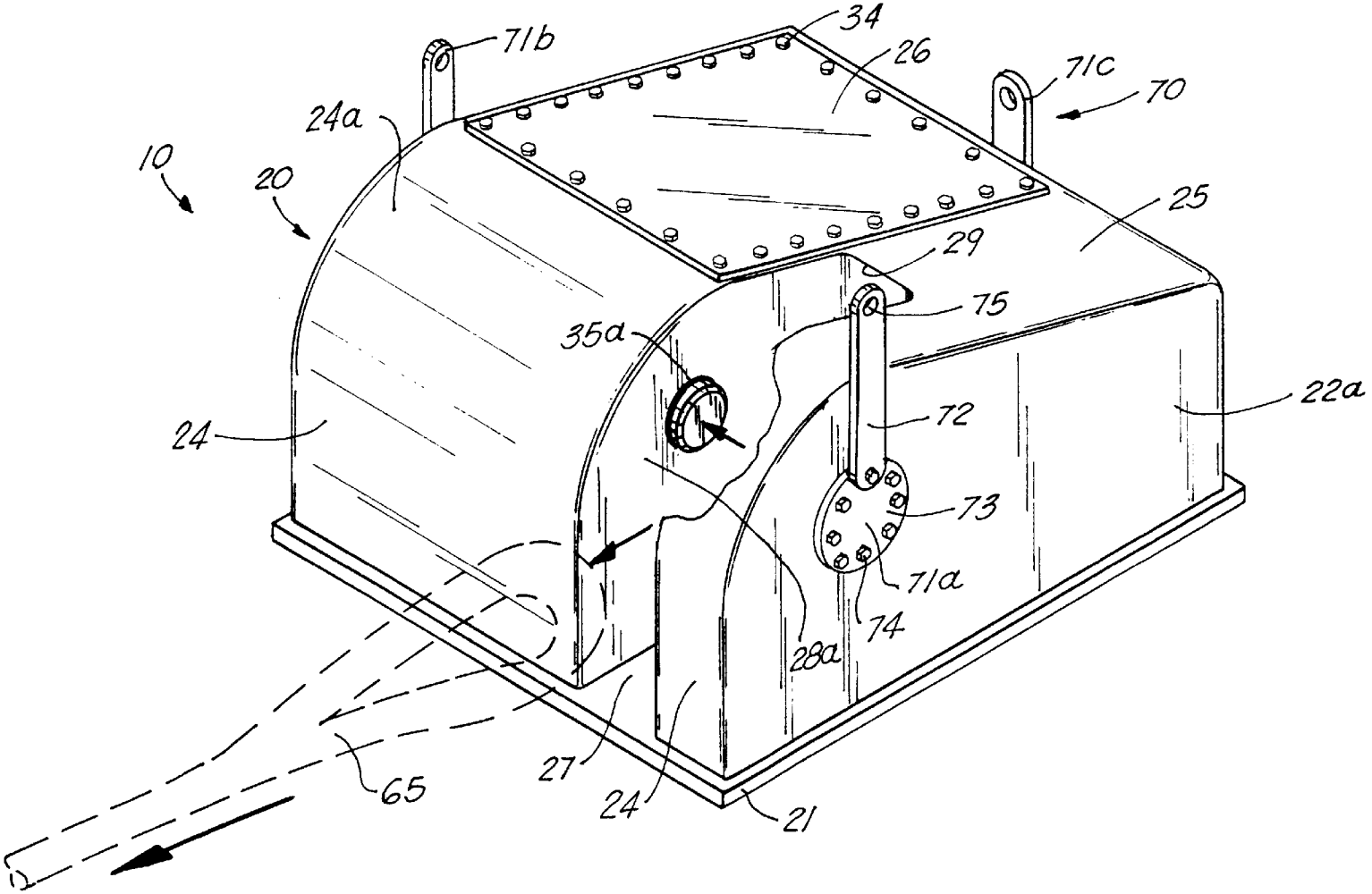
FIG. 1*a* is a perspective view of the remotely controlled mooring line quick release device of the present invention illustrating the mooring line support shaft in its first state.

Referring now to the drawing, and in particular FIGS. 1*a*, 1*b*, 2–4, the remotely controlled mooring line quick release device of the present invention is designated generally by the numeral 10. remotely controlled mooring line quick release device 10 is generally comprised of chamber 20, remotely controlled mechanical means 40, mooring line support shaft 60, transport support means 70 and a fluid line system.

Chamber 20 is compact and sealed by poly-pack seals. The poly-pack seals of chamber 20 protect the remotely controlled mechanical means 40 and the fluid line system housed therein from the environment, adverse weather conditions and corrosive properties of the waterway, thereby the mechanical integrity of the remotely controlled mechanical means 40 is not compromised. Therefore, remotely controlled mooring line quick release device 10 is reliable and durable. Additionally, since chamber 20 is compact, chamber 20 may be easily mounted at the gunnels of a marine vessel and does not protrude beyond the perimeter of the marine vessel.

Figure 1B:
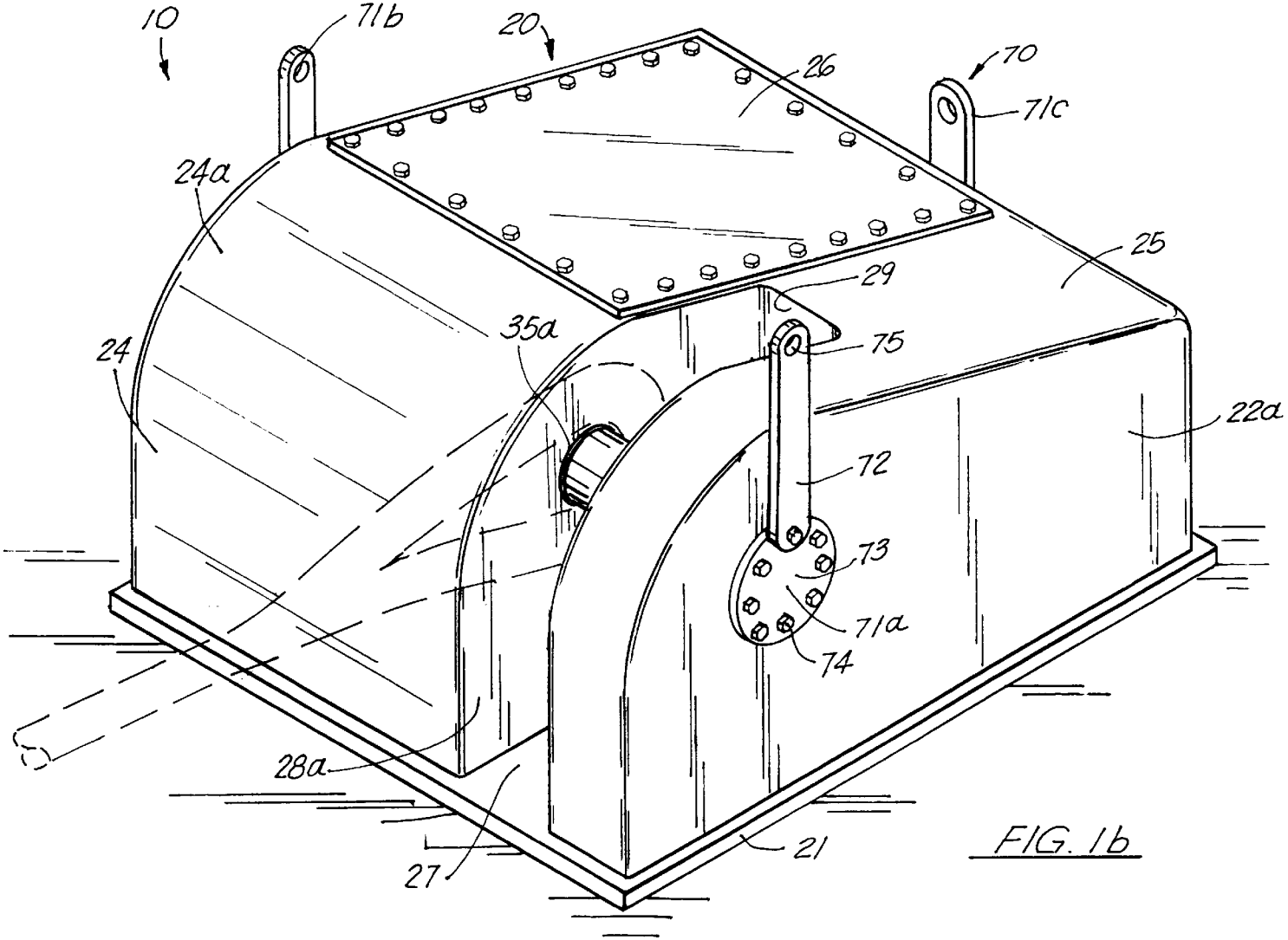
FIG. 1*b* is a perspective view of the remotely controlled mooring line quick release device of the present invention illustrating the mooring line support shaft in its second state.
Figure 2:
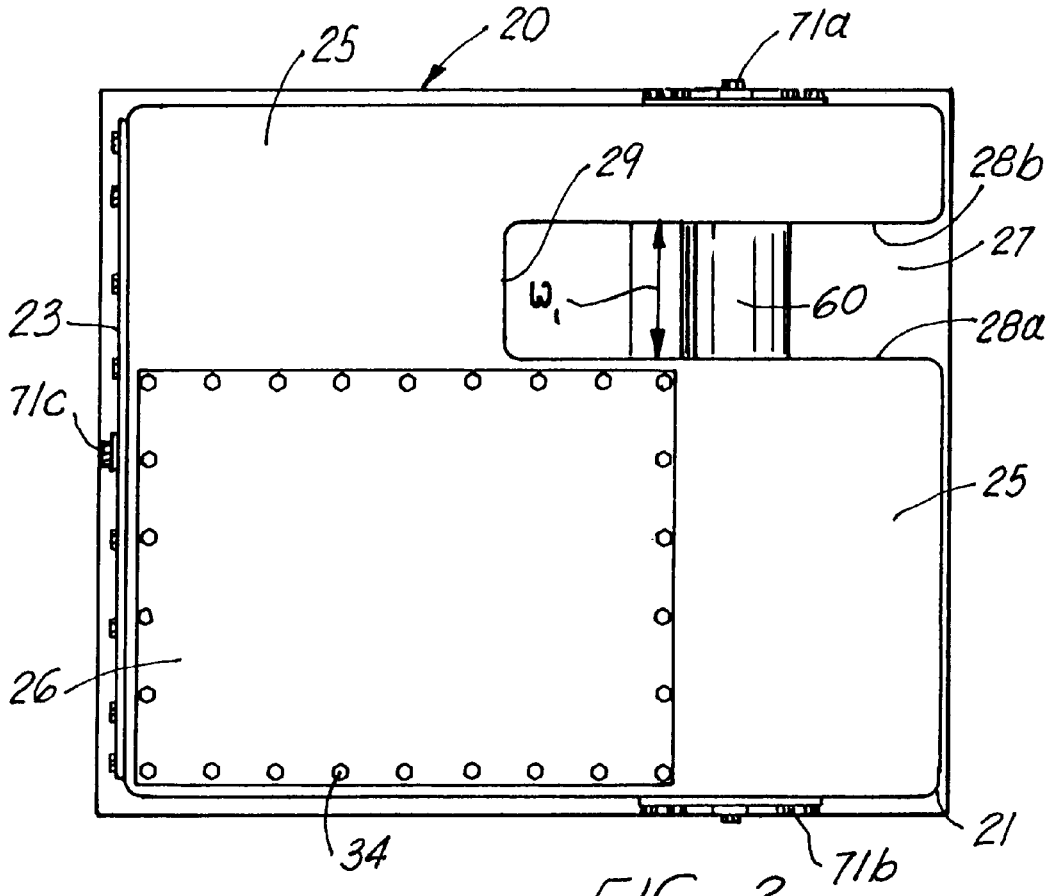
FIG. 2 is a top view of the remotely controlled mooring line quick release device of the embodiment of FIG. 1*a;*
Figure 3:
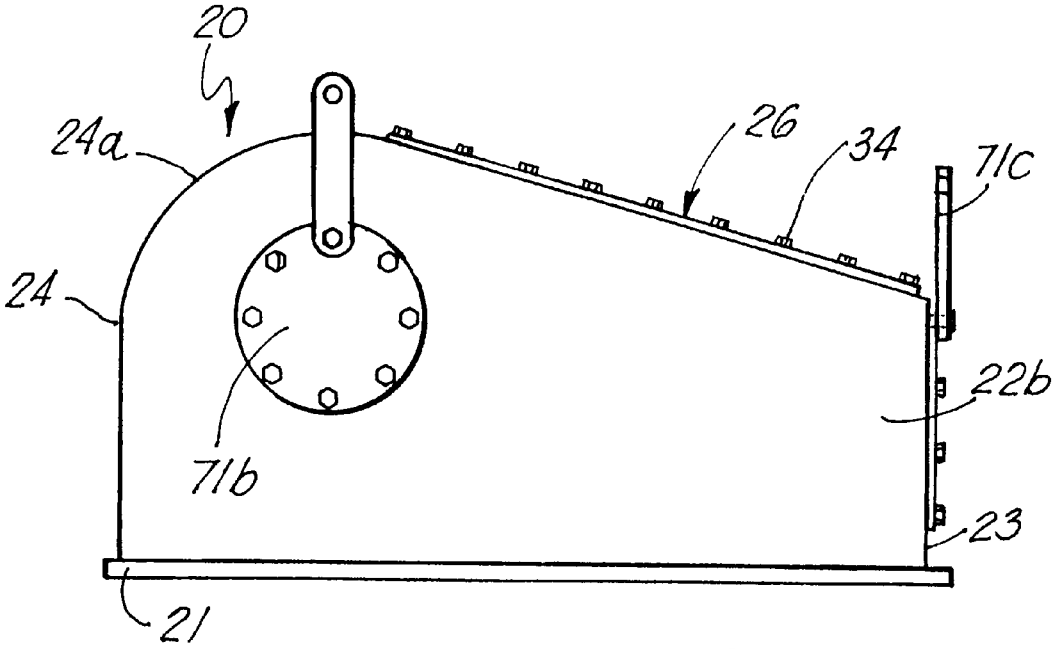
FIG. 3 is a side view of the remotely controlled mooring line quick release device of the embodiment of FIG. 1*a;*
Figure 4:
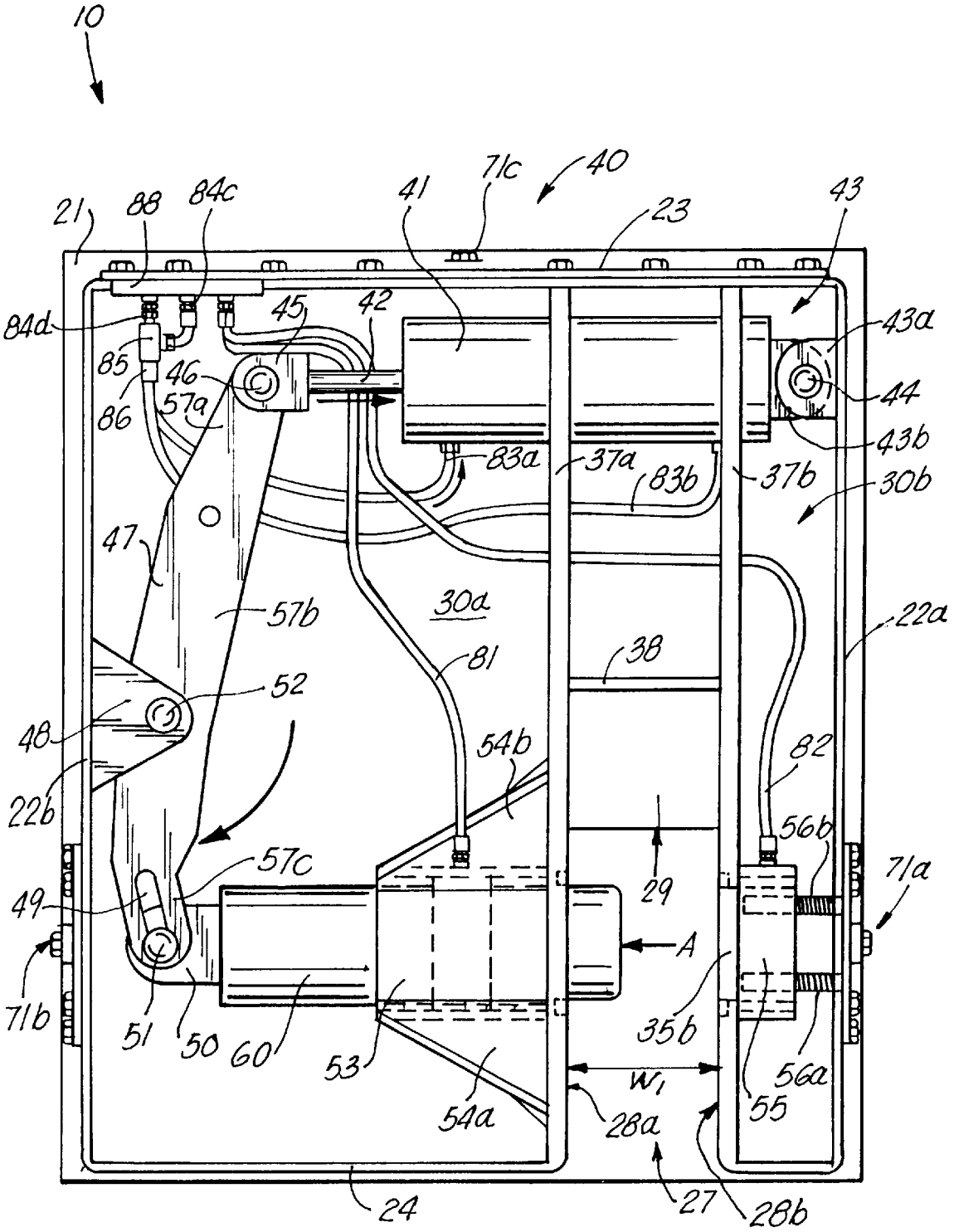
FIG. 4 is a top view of the remotely controlled mooring line quick release device having the top wall member removed illustrating the remotely controlled mechanical means and mooring line support shaft, in its third state, of the present invention.
Figure 5:
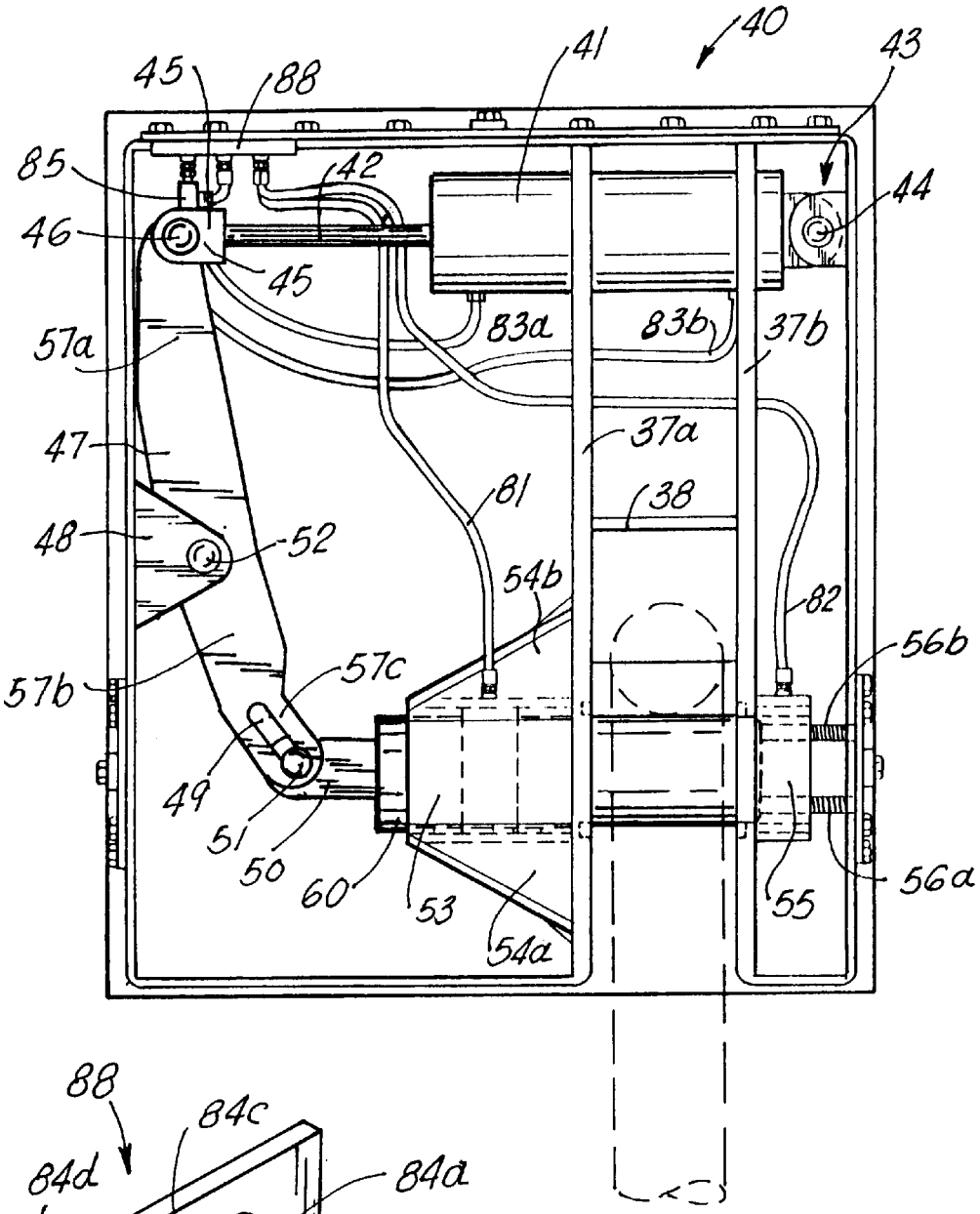
FIG. 5 is a top view of the remotely controlled mooring line quick release device having the top wall member removed illustrating the remotely controlled mechanical means and mooring line support shaft, in its second state, of the present invention.

As best seen in FIGS. 1–3, chamber 20 comprises base member 21, first and second side walls 22*a* and 22*b*, back wall 23, front wall 24, curved wall member 24*a*, top wall member 25, access panel 26, open channel 27, first and second channel walls 28*a* and 28*b*, and back channel wall 29. First side wall 22*a* has one side edge thereof coupled perpendicularly to one side edge of back wall 23 and one side edge of second side wall 22*b* is coupled perpendicularly to the other side edge of back wall 23. Each side edge of front wall 24 is coupled perpendicularly to the other edges of first and second side walls 22*a* and 22*b*. The top edge of front wall 24 is unitarily coupled to top wall member 25 via curved wall member 24*a*. The top edge of first and second side walls 22*a* and 22*b* and back wall 23 are perpendicularly coupled to top wall member 25 wherein top wall member 25 is sloped downward from curved wall member 24*a* to back wall 23. Henceforth, precipitation tends to slide down the slope of top wall member 25 and off back wall 23. Top wall member 25 has formed therein an access orifice having a portion of its border in close proximity to second side wall 22*b* and back wall 23. Access panel 26 is secured and sealed to sloped top wall member 25 for covering access orifice via a plurality of securing means 34. Access panel 26 provides a doorway into the interior of chamber 20 via said access orifice for maintaining and servicing remotely controlled mechanical means 40 therein. Open channel 27, having a width W1, is formed in front wall 24, curved wall member 24*a* and top wall member 25 for providing access to mooring line support shaft 60 in its third state for attaching mooring line 65 thereto. Open channel 27 is bounded by first and second parallel channel walls 28*a* and 28*b*, each having formed therein apertures 35*a* and 35*b*, respectively, and back channel wall 29 wherein first and second parallel channel walls 28*a* and 28*b*, and back channel wall 29 maintain chamber 20 sealed from the environment. As best seen in FIGS. 4 and 5, open channel 27 separates chamber 20 into first compartment 30*a* and second compartment 30*b*.

Chamber 20 further comprises first and second parallel support members 37*a* and 37*b* (FIG. 4) separated by width W1 and third support member 38 coupled perpendicularly to first and second parallel support members 37*a* and 37*b* wherein first and second parallel support members 37*a* and 37*b* further divide chamber 20 into first compartment 30*a* and second compartment 30*b* of chamber 20 and support sloped top wall member 25.

As best seen in FIGS. 4 and 5, remotely controlled mechanical means 40 comprises hydraulic cylinder 41, piston member 42, first chamber support structure 43, pin member 44, first connector member 45, pin member 46, reciprocating arm 47, second chamber support structure 48, pin member 52, angled sliding channel 49, second connector member 50, pin member 51, shaft conduit 53, support flanges 54*a* and 54*b*, spring-loaded spacer 55 and spring members 56*a* and 56*b*.

Hydraulic cylinder 41 receives therein piston member 42 wherein under hydraulic pressure piston member 42 is slid in and out of hydraulic cylinder 41. Hydraulic cylinder 41 is positioned parallel to back wall 23 and is secured to first side wall 22*a* via first chamber support structure 43. First chamber support structure 43 comprises first and second mated support members 43*a* and 43*b* secured together via pin member 44. First support member 43*a* is affixed to first side wall 22*a* and second chamber support member 43*b* is affixed to one distal end of hydraulic cylinder 41.

A free end of piston member 42 couples to angled back end 57*a* of reciprocating arm 47 via first connector member 45 wherein reciprocating arm 47 pivots thereabout. Reciprocating arm 47 is coupled somewhat perpendicularly between hydraulic cylinder 41 and mooring line support shaft 60. As can be appreciated, the somewhat perpendicularly coupled reciprocating arm 47 in relation to hydraulic cylinder 41 and mooring line support shaft 60 provides for a compact chamber 20.

Reciprocating arm 47 comprises angled back portion 57*a*, angled front portion 57*c* and center portion 57*b* coupled therebetween. Angled front portion 57*c* is coupled to mooring line support shaft 60 via second connector member 50. Angled front portion 57*c* of reciprocating arm 47 has formed therein angled sliding channel 49 wherein angled sliding channel 49 is coupled to second connector member 50 via pin member 51. Reciprocating arm 47 is secured to second side wall 22*b* via second chamber support structure 48 wherein reciprocating arm 47 sea-saws about pin member 52.

Shaft conduit 53 slidably receives therein mooring line support shaft 60. Shaft conduit 53 is coupled to first channel wall 28*a* via support flanges 54*a* and 54*b* for securing shaft conduit 53 to first compartment 30*a* of chamber 20. Spring-loaded spacer 55 is positioned in second compartment 30*b*. One end of spring-loaded spacer 55 has coupled thereto first and second spring members 56*a* and 56*b* wherein when mooring line support shaft 60 transitions during its third state from said first state to said second state, spring members 56*a* and 56*b* serve to absorb pressure as mooring line support shaft 60 is advancing through aperture 35*b*.

Figure 6:
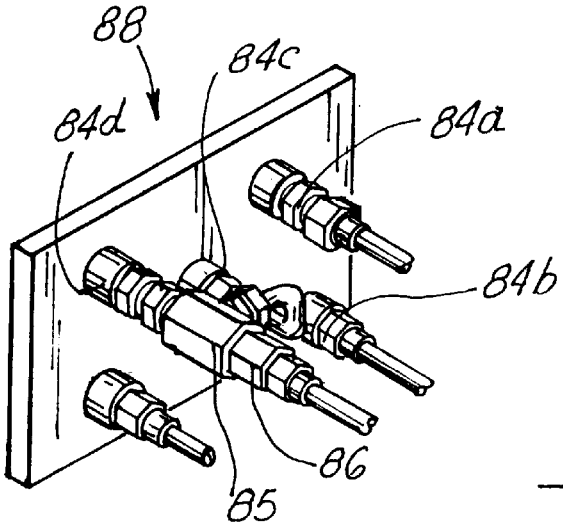
FIG. 6 illustrates a detailed view of the fluid line connector panel of the present invention; and, FIGS. 7–9 represent a schematic illustration of one hydraulic system for the present invention.

Referring now to FIGS. 4–6, the fluid line control system comprises shaft conduit line 81, spring-loaded spacer line 82, and first and second hydraulic cylinder lines 83*a* and 83*b*. Shaft conduit line 81 and spring-loaded spacer line 82 receive therein a lubricant for lubricating the interior surfaces of shaft conduit 53 and spring-loaded spacer 55, respectively. Second hydraulic cylinder line 83*b* serves to fill hydraulic cylinder 41 with a fluid such as air. First hydraulic cylinder line 83*a* services to bleed hydraulic cylinder 41 of such fluid. The fluid line control system further comprises fluid line connector panel 88 having a plurality of connector ports 84*a*, 84*b*, 84*c* and 84*d* coupled thereto for coupling to shaft conduit line 81, spring-loaded spacer line 82, and first and second hydraulic cylinder lines 83*a* and 83*b*, respectively. Fluid line connector panel 88 is secured and sealed to the exterior surface of back wall 23.

Connector ports 84*a* and 84*b* couple to shaft conduit line 81 and spring-loaded spacer line 82, respectively, for filling shaft conduit line 81 and spring-loaded spacer line 82 with the lubricant from a remote source (NOT SHOWN). Connector ports 84*c* and 84*d* couple to first and second hydraulic cylinder lines 83*a* and 83*b* via quick release valve 85 having coupled thereto flow valve 86. Quick release valve 85 is remotely controlled to quickly release mooring line 65 whereby quick release valve 85 is opened to bled the fluid out of hydraulic cylinder 41. Additionally, flow valve 86 serves to couple the fluid of first hydraulic cylinder line 83*a* to quick release valve 85 so that the bled fluid may be expelled via port 84*c*. Quick release valve 85 and flow valve 86 are further controlled (remotely) to couple the fluid, from a remote source (NOT SHOWN), to second hydraulic cylinder line 83*b* to fill hydraulic cylinder 41.

Mooring line support shaft 60 is a cylindrical shaft which serves to support mooring line 65 used to moor the marine vessel. The longitudinal surface of mooring line support shaft 60 is parallel to base member 21. Mooring line support shaft 60 has a first state, a second state and a third state.

When mooring line support shaft 60 is in said first state, as best seen in FIG. 1*a*, mooring line support shaft 60 is retracted into chamber 20. In said first state, remotely controlled mooring line quick release device is idle. On the other hand when mooring line support shaft 60 is in said second state, as best seen in FIGS. 1*b* and 5, mooring line support shaft 60 is received in spring-loaded spacer 55 via open channel 27. In said second state, remotely controlled mooring line quick release device is mooring the marine vessel. In said third state, as best seen in FIG. 4, mooring line support shaft is being retracted (in the direction of ARROW A) into chamber 20 for the quick release of mooring line 65 from said mooring line support shaft 60.

Transport support means 70 comprises first, second and third lifting members 71*a*, 71*b*, and 71*c*. First and second lifting members 71*a* and 71*b* are affixed to first and second side wall 22*a* and 22*b*, respectively. Third lifting member 71*c* is affixed to back wall 23. First, second and third lifting members 71*a*, 71*b* and 71*c* serve to balance chamber 20 as chamber 20 is lifted on or off a marine vessel. Since first, second and third lifting members 71*a*, 71*b* and 71*c* are identical, only one such lifting member will be described in detail.

First lifting member 71*a* comprises support bar 72 and connector plate 73 affixed to first side wall 22*a* via a plurality of securing means 74. Support bar 72 is an elongated member which is parallel to first side wall 22*a* such that support bar 72 projects beyond top wall member 25. Support bar 72 has formed therein, at one end thereof, lifting aperture 75 and, at the other end, aperture 76 for receiving therein one of the plurality of securing means 74 for affixing support bar 72 to connector plate 73. In order to transport and lift chamber 20, a hook member of a transport lift system (not shown) is inserted into lifting aperture 75 of first lifting member 71*a*, second lifting member 71*b*, and third lifting member 71*c*. Chamber 20 may then be lifted off of or onto the gunnels of a marine vessel.

In operation, to moor a marine vessel, the fluid such as air is transferred to second hydraulic cylinder line 83*b* for filling hydraulic cylinder 41. As hydraulic cylinder 41 is filled piston member 42 is forced upward. As piston member 42 moves upward, reciprocating arm 47 is moved into a first position, best seen in FIG. 5. As reciprocating arm 47 moves a force of pressure is applied to mooring line support shaft 60 (while in its first state) such that mooring line support shaft 60 is ejected from first compartment 30*a* into open channel 27 wherein mooring line 65 may be coupled to mooring line support shaft 60. Mooring line support shaft 60 further advances into spring-loaded spacer 55 in second compartment 30*b* thereafter mooring line support shaft 60 is in its second state and remotely controlled mooring line quick release device 10 in mooring a marine vessel.

In operation, to quickly release a mooring line used to moor a marine vessel, the fluid in hydraulic cylinder 41 is bled via first hydraulic cylinder line 83*a* out of chamber 20. As hydraulic cylinder 41 is bled piston member 42 moves downwardly. As piston member 42 moves downwardly, reciprocating arm 47 is moved into a second position, as best seen in FIG. 4. As reciprocating arm 47 moves a force of pressure is applied to mooring line support shaft 60 such that mooring line support shaft 60 is retracted from second compartment 30*b* and into first compartment 30*a* via open channel 27 wherein mooring line 65 is slid off of the retracting mooring line support shaft 60 to quickly release such mooring line.

Figure 7:
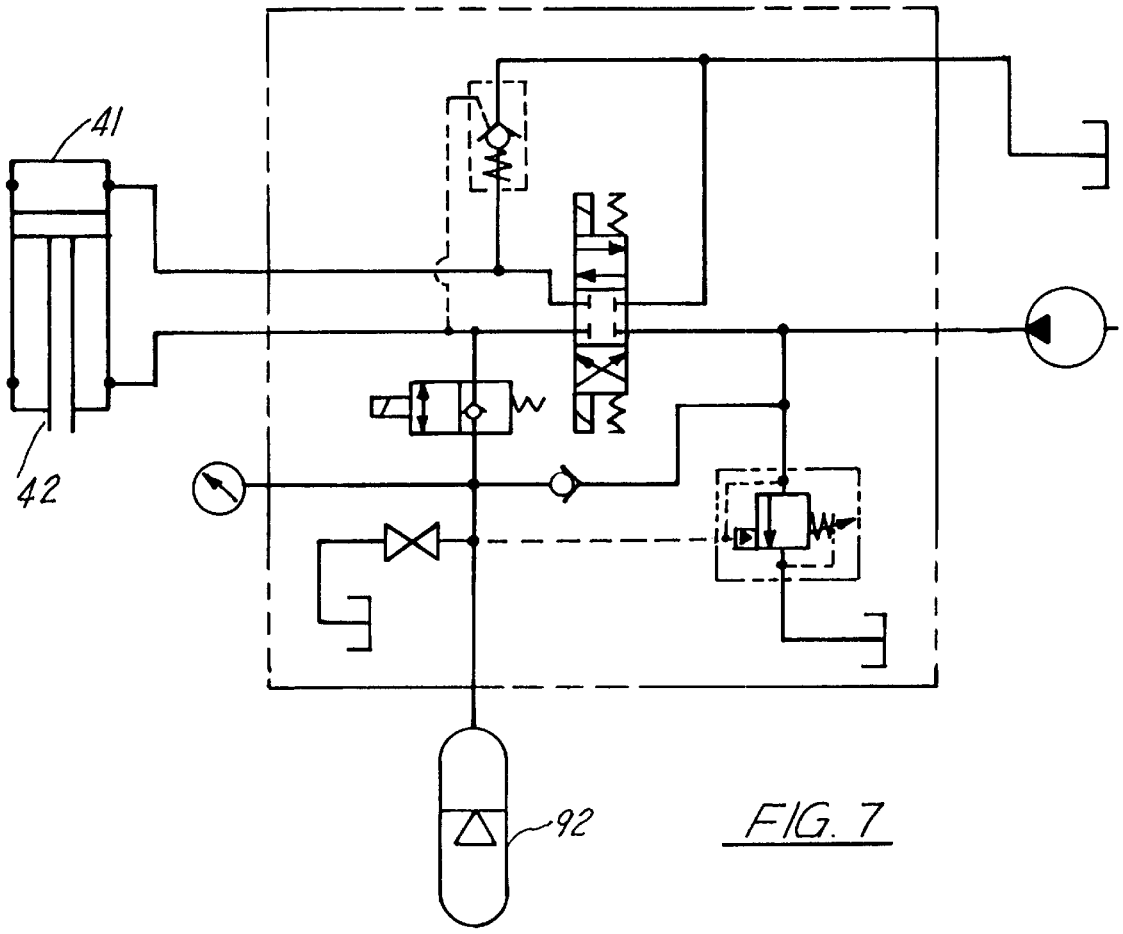
Figure 9:
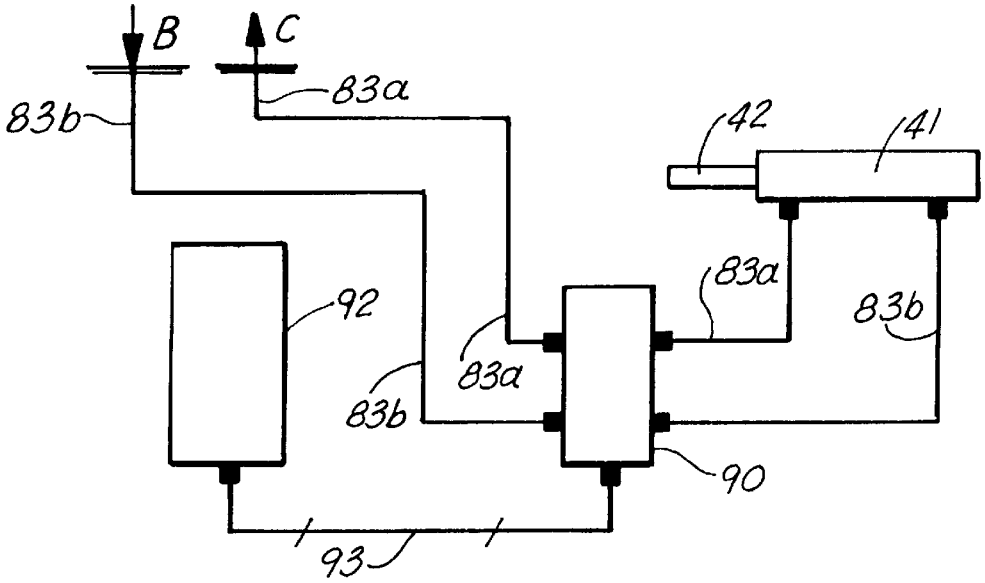
Figure 8:
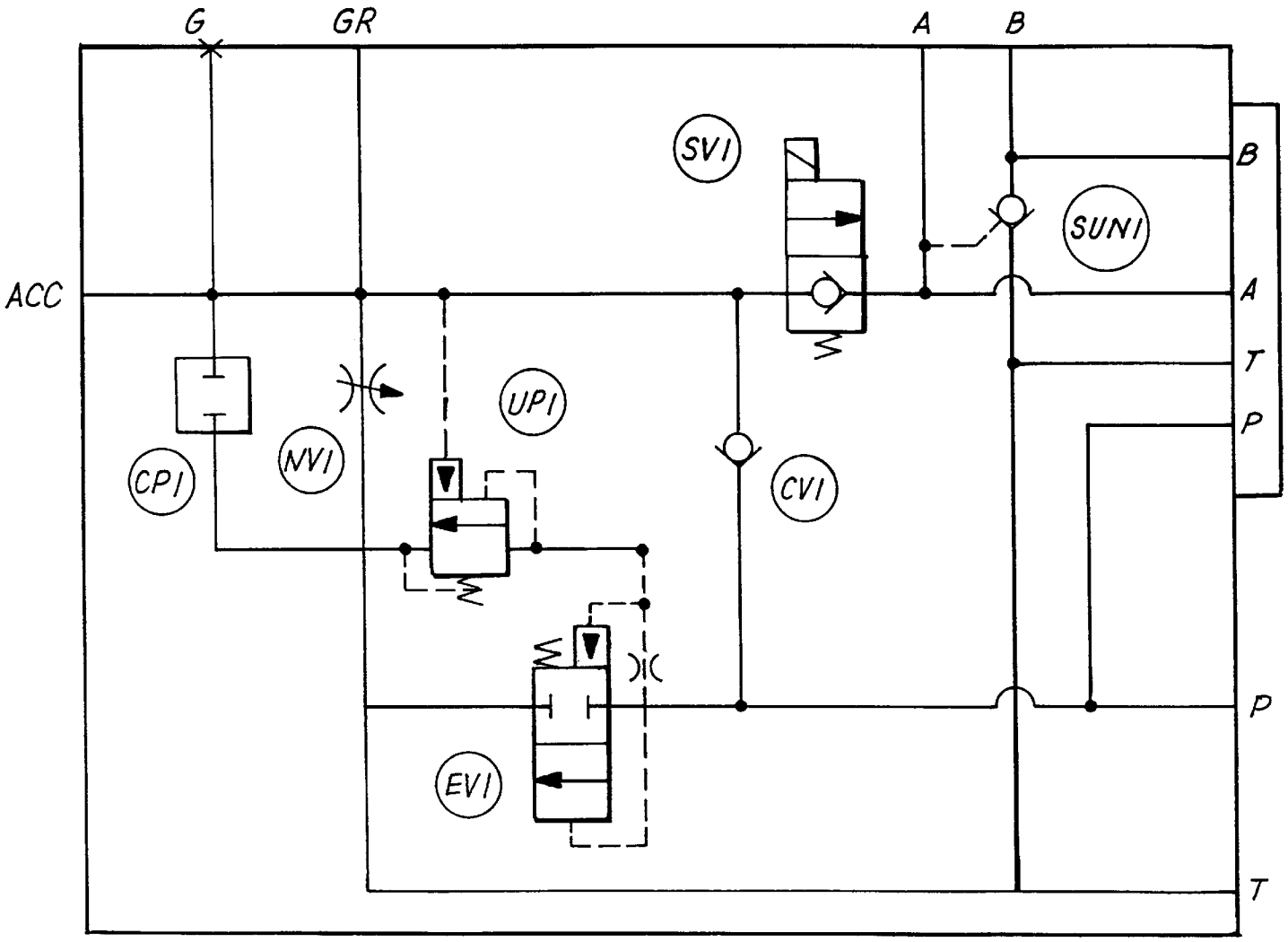

FIGS. 7–9 schematically illustrate the preferred arrangement for the hydraulic system. Here manifold 90 is connected to accumulator 92 by line 93 with manifold 90 in turn controlling lines 83*a*, 83*b* by conventional valving (NOT SHOWN). Pressure inlet (ARROW B) and outlet or "return" (ARROW C) service cylinder 41 through manifold 90. Accumulator 92 can be pre-charged with nitrogen gas which is compressible by the hydraulic fluid. In operation, accumulator 92 is automatically charged at the end of each piston stroke to give the operator the capability to release hawser 65 under any conditions. The manual override located on the side of housing 20 allows hawser 65 to be released in emergency situations at remote locations such as the captain's console.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A mooring line quick release device for quickly releasing a mooring line, comprising:

(a) a chamber, which is compact and sealed, having a first compartment and a second compartment separated by an open channel bounded by a wall of said first compartment, having formed therein a first aperture, and a wall of said second compartment, having formed therein a second aperture;

(b) a mooring line support shaft housed in said chamber, wherein said mooring line support shaft has a longitudinal surface which passes through said first aperture to said second apertures via said open channel when said mooring line support shaft is changed between a first state to a second state thereof; and, (c) a mechanical means, housed in said chamber, for changing said mooring line support shaft from said second state to said first state via a third state for quickly releasing said mooring line, wherein when said mooring line support shaft is in said third state, said mooring line support shaft is being retracted out of said second compartment and into said first compartment via said open channel for the quick release of said mooring line.

2. The mooring line quick release device of claim 1, wherein said chamber comprises:

a base member;

first and second parallel side walls;

back wall coupled perpendicularly to one side edge of said first and second parallel side walls;

front wall coupled perpendicularly to the other side edge of said first and second parallel side walls;

curved wall member unitarily coupled to a top edge of said front wall; and, top wall member coupled to a top edge of said first and second parallel side walls, said back wall and said curved wall member wherein said top wall member is sloped downward from said curved wall member to said back wall.

3. The mooring line quick release device of claim 2, wherein said top wall member has formed therein an access orifice and said chamber further comprises an access panel for closing said access orifice.

4. The mooring line quick release device of claim 1, wherein said mechanical means is a hydraulically operated mechanical means.

5. The mooring line quick release device of claim 1, wherein said mechanical means is remotely controlled.

6. The mooring line quick release device of claim 4, wherein said hydraulically mechanical means comprises:

a hydraulic cylinder;

a piston member coupled to said hydraulic cylinder; and, a reciprocating arm coupled to said piston and said mooring line support shaft for moving said mooring line support shaft between said first state, said second state and said third state thereof.

7. A mooring line quick release device for quickly releasing a mooring line, comprising:

(a) means for housing, which is compact and sealed, having a first compartment and a second compartment separated by an open channel bounded by a wall of said first compartment, having formed therein a first aperture, and a wall of said second compartment, having formed therein a second aperture;

(b) mooring line support means, housed in said housing means, for supporting a mooring line wherein said mooring line support means has a longitudinal surface which passes through said first aperture to said second apertures via said open channel when said mooring line support means is changed between a first state to a second state thereof; and (c) a remotely control mechanical means, housed in said housing means, for changing said mooring line support means from said second state to said first state via a third state for quickly releasing said mooring line, wherein when said mooring line support means is in said third state, said mooring line support means is being retracted out of said second compartment and into said first compartment via said open channel for the quick release of said mooring line.

8. The mooring line quick release device of claim 7, wherein said housing means comprises:

a base member;

first and second parallel side walls;

back wall coupled perpendicularly to one side edge of said first and second parallel side walls;

front wall coupled perpendicularly to the other side edge of said first and second parallel side walls;

curved wall member unitarily coupled to a top edge of said front wall; and, top wall member coupled to a top edge of said first and second parallel side walls, said back wall and said curved wall member wherein said top wall member is sloped downward from said curved wall member to said back wall.

9. The mooring line quick release device of claim 8, wherein said top wall member has formed therein an access orifice and said housing means further comprises an access panel for closing said access orifice.

10. The mooring line quick release device of claim 7, wherein said remotely controlled mechanical means is a hydraulically operated mechanical means.

11. The mooring line quick release device of claim 10, wherein said remotely controlled mechanical means comprises:

a hydraulic cylinder;

a piston member coupled to said hydraulic cylinder; and, a reciprocating arm coupled to said piston and said mooring line support shaft for moving said mooring line support shaft between said first state, said second state and said third state thereof.

12. A mooring line quick release device for quickly releasing a mooring line, comprising:

(a) means for housing, which is compact and sealed, having a first compartment and a second compartment separated by an open channel bounded by a wall of said first compartment and a wall of said second compartment, said housing means further comprises:
  i) a base member,
  ii) first and second parallel side walls,
  iii) back wall coupled perpendicularly to one side edge of said first and second parallel side walls, and
  iv) front wall coupled perpendicularly to the other side edge of said first and second parallel side walls,
  v) curved wall member unitarily coupled to a top edge of said front wall, and
  vi) top wall member coupled to a top edge of said first and second parallel side walls, said back wall and said curved wall member wherein said top wall member is sloped downward from said curved wall member to said back wall;

(b) mooring line support means, housed in said housing means, for supporting a mooring line wherein said mooring line support means has a longitudinal surface which passes from said first compartment to said second compartment via said open channel when said mooring line support means is changed between a first state to a second state thereof; and, (c) a remotely control mechanical means, housed in said housing means, for changing said mooring line support means from said second state to said first state via a third state for quickly releasing said mooring line, wherein when said mooring line support means is in said third state, said mooring line support means is being retracted out of said second compartment and into said first compartment via said open channel for the quick release of said mooring line.

13. The mooring line quick release device of claim 12, wherein said top wall member has formed therein an access orifice and said housing means further comprises an access panel for closing said access orifice.

14. The mooring line quick release device of claim 12, wherein said remotely controlled mechanical means is a hydraulically operated mechanical means.

15. The mooring line quick release device of claim 12, wherein said remotely controlled mechanical means comprises:

a hydraulic cylinder;

a piston member coupled to said hydraulic cylinder; and, a reciprocating arm coupled to said piston and said mooring line support shaft for moving said mooring line support shaft between said first state, said second state and said third state thereof.

* * * * *